US005084655A

United States Patent [19]

Van Zanten

[11] Patent Number: 5,084,655

[45] Date of Patent: Jan. 28, 1992

[54] CIRCUIT ARRANGEMENT SUITABLE FOR IGNITING A HIGH-PRESSURE DISCHARGE LAMP

[75] Inventor: Egbert Van Zanten, Grave, Netherlands

[73] Assignee: U.S. Philips Corporation, New York, N.Y.

[21] Appl. No.: 618,777

[22] Filed: Nov. 27, 1990

[30] Foreign Application Priority Data

Jan. 11, 1990 [NL] Netherlands ..... 9000077

[51] Int. Cl.[5] ..... H05B 41/04

[52] U.S. Cl. ..... 315/290; 315/DIG. 7

[58] Field of Search ..... 315/209 CD, 239, 240, 315/243, 290, DIG. 2, DIG. 5, DIG. 7

[56] References Cited

U.S. PATENT DOCUMENTS 4,209,730 6/1980 Pasik ..... 315/244 X 4,441,056 3/1984 Siglock ..... 315/290

4,461,982 7/1984 Faharich ..... 315/290

4,890,041 12/1989 Nuckolls et al. ..... 315/DIG. 5 X

*Primary Examiner*—David Mis

[57] ABSTRACT

A circuit arrangement for igniting a high-pressure discharge lamp (6), in which ignition voltages are generated by means of discharges from two capacitors (10, 14) through a primary winding (12) of a transformer. During this, the lamp (6) is connected to a secondary winding (4) of this transformer. One capacitor (14) is charged to a higher voltage than the other capacitor (10), the two capacitors being discharged alternately through breakdown elements (11, 15) associated with the capacitors (10, 14, respectively). An ignition pulse with a low peak value for igniting the lamp (6) in the cold state is then followed by an ignition pulse with a high peak value for igniting the lamp (6) if it should be in the hot state.

5 Claims, 1 Drawing Sheet

CIRCUIT ARRANGEMENT SUITABLE FOR IGNITING A HIGH-PRESSURE DISCHARGE LAMP

The invention relates to a circuit arrangement suitable for igniting a high-pressure discharge lamp, which arrangement is to be fed from an AC voltage source and is provided with a first series circuit comprising a first rectifier and a first capacitor, and in which a second series circuit comprising at least a first switching element and a primary winding of a transformer is connected to a junction point between the first rectifier and the first capacitor, while an output terminal of the circuit arrangement is connected to a secondary winding of the said transformer, the circuit arrangement further comprising a third series circuit comprising a second rectifier and a second capacitor, the forward directions of the rectifiers being of different orientation relative to the supply source.

A known circuit arrangement of the kind indicated is described in, for example, U.S. Pat. No. 4,209,730.

A disadvantage of this known circuit arrangement is that the ignition pulses generated by it are to a high degree uniform. This is true for, for example, the level of the peak voltage of these pulses.

This can be explained as follows. Each voltage pulse is generated in the known circuit arrangement by means of a joint discharge of the two capacitors. One joint discharge hardly differs from the previous joint discharge.

It is known, however, that the peak voltage of an ignition pulse required for igniting a high-pressure discharge lamp depends on whether a cold lamp or a hot lamp is to be ignited. The latter case occurs, for example, if the relevant lamp was recently extinguished. The voltage which the circuit arrangement is required to supply together with the instantaneous mains voltage must be higher then than in the case of a cold lamp start.

In the known circuit arrangement, consequently, the voltage offered to the lamp will either be higher than necessary each time in the case of a cold lamp start, or it will be just sufficient to achieve a cold lamp start but insufficient to ignite a hot lamp.

A disadvantage of the first option, which leads to lamp components being subjected to an excessive voltage too often, is the attack on, for example, insulation, and thus the shortening of lamp life. The inability to ignite a hot lamp is obviously also a disadvantage.

The invention has for its object to provide a circuit arrangement of the kind described in the opening paragraph with which a high-pressure discharge lamp can be ignited both in the cold and in the hot state without this lamp being continuously presented with starting pulses with too high peak values for its ignition in the cold state.

A circuit arrangement according to the invention, suitable for igniting a high-pressure discharge lamp is for this purpose characterized in that a second switching element is present in a branch between on the one hand a junction point between the second rectifier and the second capacitor and on the other hand a transformer winding, which winding is coupled to a second winding connected to an output terminal, and in that means are present for making the switching elements alternately conducting.

An advantage of this circuit arrangement is that it renders it possible to generate other ignition pulses during half cycles of the AC supply voltage having positive polarity than during half cycles of the AC voltage having negative polarity. The former pulses may be suitable, for example, for igniting exclusively a cold lamp. The other pulses may have a higher peak value and thus be suitable for igniting a hot lamp.

This can be explained as follows. Let us assume that the first capacitor is charged during the half cycles having positive polarity of the AC supply voltage, and the second capacitor during the half cycles having negative polarity by way of the second rectifier, which has a different orientation compared with the first rectifier. A discharge current from the first capacitor, flowing through the second series circuit while the switching element is in a conducting state, results in a voltage pulse across the secondary winding of the transformer, which pulse can be supplied to the lamp by way of the output terminal. A discharge current from the second capacitor, flowing through the second switching element, is also converted into a voltage peak by transformer action and supplied to the lamp in the same manner.

The discharges of the two capacitors take place one after the other because a capacitor discharge current flows in a half cycle following the one in which this capacitor was charged, also in view of the above. This is made possible by having the two switching elements conduct alternately. A delay in making the switching elements conducting enhances the pulse-shaped character of the discharge currents and thus of the ignition voltages to be generated by the circuit arrangement in this process. A switching element may, for example, be constructed as a controlled switching element which is not switched on until a threshold voltage has been reached in the control circuit.

Since the ignition pulses generated in a circuit arrangement according to the invention during the odd half cycles are produced in a circuit which is at least partly a different circuit from the one in which the ignition pulses are generated during the even half cycles, it is possible to create a difference in peak value between these pulses. Thus, for example, a pulse for igniting only a cold lamp will be followed by a pulse of higher voltage suitable for igniting a hot lamp.

The invention is consequently based on the idea of generating other ignition pulses during the half cycles having positive polarity of the AC supply voltage than during the half cycles having the opposite polarity. Furthermore, this can be achieved in a circuit arrangement according to the invention without an increase in the number of capacitors.

A circuit arrangement according to the invention could, for example, be provided with two transformers, the ignition pulses with a low peak value being passed on to the lamp through the secondary winding of the first transformer. The ignition pulses with a high peak value could then be passed on to the lamp through the secondary winding of the second transformer. For this purpose, these transformers have, for example, different winding ratios.

In a first preferred embodiment of a circuit arrangement according to the invention, the primary winding of the transformer and the transformer winding are one and the same winding, while also the secondary winding of the transformer and the second winding are one and the same winding.

An advantage of this preferred embodiment is that the circuit arrangement can be simple, since only one transformer suffices.

In the said preferred embodiment, for example, the second capacitor is connected to a tap of the primary winding of the transformer and the first capacitor is connected to an end of this primary winding in such a way that the discharge current of the second capacitor flows through fewer primary turns of the transformer than does the discharge current of the first capacitor. At the secondary side of the transformer, and thus at the output terminal of the circuit arrangement, this can then lead to a desired higher voltage pulse resulting from a discharge of the second capacitor compared with a discharge of the first capacitor.

In an improvement of the said preferred embodiment of a circuit arrangement according to the invention, the first capacitor together with the second series circuit forms part of an oscillation circuit across whose ends there is an AC voltage in the operational state while the first switching element is conducting, and the third series circuit bypasses a portion of the oscillation circuit comprising the first capacitor, the first switching element and the primary winding of the transformer.

The term oscillation circuit is here understood to mean a circuit comprising at least a coil and a capacitor, in which upon switching-on at a DC voltage—and while the capacitor is initially uncharged—the voltage across the capacitor first overshoots its final value.

An advantage of this improvement is that the second capacitor can thus be charged to a higher voltage than the first capacitor in a very simple way. This can then lead to a desired stronger ignition pulse coming from the second capacitor compared with that coming from the first capacitor.

This can be explained as follows. When the first switching element becomes conducting, this gives in fact a switch-on effect of an LC circuit consisting of, for example, a ballast and the first capacitor, the first capacitor C at the switch-on moment having a bias whose polarity does not correspond to that of the supply voltage applied across the oscillation circuit. After an initial discharge of the first capacitor C this then leads to a reversed charging of this capacitor to a value which could lie above twice the bias.

Since the charging action of the first capacitor preceding the moment the first switching element becomes conducting will lead to a bias of that capacitor which is practically equal to the peak value of the AC supply voltage of the circuit arrangement, the switch-on effect will be capable of causing an inverted charging of the first capacitor up to twice the peak value of the AC supply voltage of the circuit arrangement.

This means that in this inverted condition of the first capacitor an increased voltage is across this capacitor, but also across the combination of this first capacitor with the conducting first switching element and the primary winding of the transformer, which increased voltage has such a polarity that the third series circuit bypassing this combination can be supplied by it. Consequently, this leads to charging of the second capacitor to a voltage which is now in excess of the peak value of the AC supply voltage of the circuit arrangement because—as was stated above—an increased voltage was generated between the ends of the third series circuit.

The second switching element could, just as the first switching element, be a controlled switching element provided with a control circuit connected to the AC supply voltage source of the circuit arrangement, in such a way that the switching element would be made conducting through the action of a sensor each time at a certain moment in the phase of the said supply voltage, and be made non-conducting again shortly afterwards.

In a further preferred embodiment of a circuit arrangement according to the invention each of the two switching elements is constructed as a breakdown element.

An advantage of this preferred embodiment is that control devices for the switching elements can be dispensed with. The first switching element in fact reacts automatically to the voltage situation in the second series circuit in this case, and the second switching element reacts to the voltage situation in the circuit of which the second capacitor and the primary winding of the transformer form part.

Since a breakdown of one switching element can be achieved in a half cycle of the AC supply voltage of the circuit arrangement in this case and a breakdown of the other switching element in the next half cycle, this is a simple means for making the switching elements alternately conducting.

In an improvement of the last-mentioned preferred embodiment, the breakdown voltage of the second switching element is greater than that of the first switching element.

An advantage of this improvement is that the second capacitor is given the possibility here to be charged first to a higher voltage. This then benefits the ignition pulse subsequently produced during the discharge.

In an improvement of the first preferred embodiment referred to hereinbefore of a circuit arrangement according to the invention, an end of the primary winding of the transformer remote from the first switching element is connected to a junction point between the secondary winding of the transformer and a stabilizing ballast.

An advantage of this improvement is that the switching device can be used as a series igniter of the lamp in a simple way, whereby in fact the pulses generated in the secondary winding are superimposed on the mains voltage supplied through the stabilizing ballast.

The invention will be explained in more detail with reference to a drawing in which.

Figure 1:
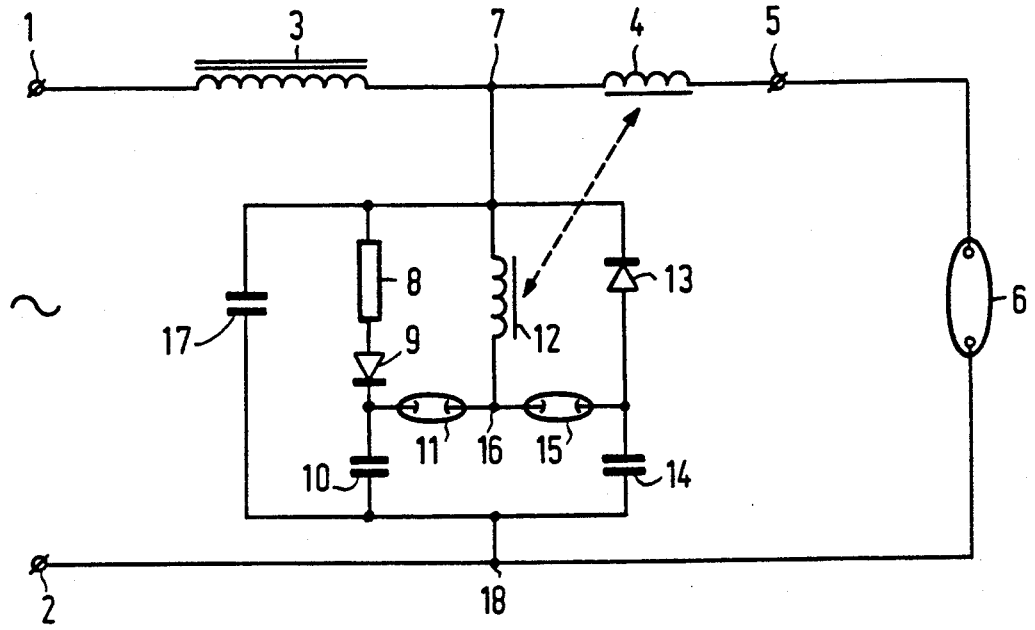
FIG. 1 shows an electric circuit of an embodiment of a circuit arrangement according to the invention and a high-pressure discharge lamp connected to this arrangement.

In FIG. 1, reference numerals 1 and 2 denote input terminals which are to be connected to a supply source which supplies a practically sinusoidal AC voltage of approximately 220 V 50 Hz. An inductive stabilizing ballast 3 is connected to terminal 1. The other end of the ballast 3 is connected to a secondary winding 4 of a transformer. Another end of this secondary winding 4 is designated as output terminal 5 and is connected to an electrode of a high-pressure discharge lamp 6. A second electrode of the lamp 6 is connected to the input terminal 2.

A junction point 7 between the ballast 3 and the secondary winding 4 is connected to a parallel circuit comprising three branches. The other end of this parallel circuit is connected to the input terminal 2. One branch of the parallel circuit comprises a first series circuit of a resistor 8, a rectifier 9 and a first capacitor 10. To a junction point between the rectifier 9 and the first capacitor 10 is furthermore connected a second series circuit comprising a first switching element 11 constructed as a breakdown element and a primary winding 12 of a transformer of which the secondary winding was given the reference numeral 4.

A second branch of the parallel circuit comprises a third series circuit of a second rectifier 13 and a second capacitor 14. A junction point between the rectifier 13 and the capacitor 14 is connected to a second switching element 15 which is constructed as a breakdown element. The other end of this switching element 15 is connected to a junction point 16 between the first switching element 11 and the primary winding 12 of the transformer.

The third branch of the parallel circuit comprises a capacitor 17.

When the first switching element 11 is in the conducting state, furthermore, the first capacitor 10 together with the first switching element 11 and the primary winding 12 of the transformer forms part of an oscillation circuit 1, 3, 7, 12, 11, 10, 2. The inductive component of this circuit is in this case practically entirely formed by the stabilizing ballast 3. An AC voltage is present between the ends 1, 2 of the said oscillation circuit in the operational state.

In an embodiment, the breakdown voltage of the first switching element 11 was approximately 500 V and that of the second switching element 15 approximately 750 V.

The circuit described operates as follows. When the AC voltage is applied between the input terminals 1 and 2, the first capacitor 10 will be charged through the circuit 1, 3, 7, 8, 9, 10, 2, if terminal 1 is positive relative to terminal 2, until a voltage has been reached which is practically equal to the peak value of the voltage between the input terminals 1 and 2.

During the next half cycle the terminal 1 will be negative relative to the terminal 2. In that case practically twice the peak value of the mains voltage would be present across the switching element 11, if the latter should not become conducting. This is practically $2\times310$.

The switching element 11 constructed as a breakdown element, however, is conducting at 500 V already in the embodiment described. When that happens, a switch-on effect occurs in which the polarity of the initial bias across the first capacitor 10 does not correspond to that of the applied mains voltage between the terminals 1 and 2. The result is that the first capacitor 10 is discharged abruptly and is then charged in reverse direction up to a voltage which is higher than the said previously realised bias of this capacitor. The resulting current flows through the switching element 11, the primary winding 12 of the transformer, and the ballast 3. This leads to a high voltage across the secondary winding 4 owing to the action of the transformer 12, 4. A superimposition of this voltage on the instantaneous mains voltage is then passed on to the lamp through the terminal 5. The resulting voltage thus generated is suitable for igniting lamp 6 in the cold state.

If the lamp should fail to be ignited upon this, the further operation of the circuit arrangement is as follows. While the polarity of the first capacitor is being inverted, there is also a voltage across the combination of the capacitor 10, the switching element 11, and the winding 12 of the transformer. This voltage has such a polarity that the second capacitor 14 in the third series circuit 14-13 can be charged up to that same voltage with it. This latter voltage is higher than the original bias of the first capacitor 10. When the voltage across the second switching element 15 has reached the value 750 V in the next half cycle of the AC voltage between the terminals 1 and 2, this switching element becomes conducting. The second capacitor 14 is then abruptly discharged through this second switching element 15 and the primary winding 12 of the transformer. This causes an ignition pulse of a high peak value across the lamp 6 through the secondary winding 4. This is obviously superimposed on the mains voltage again. This superimposed voltage is sufficient to ignite the lamp 6 in the hot state.

If, however, the lamp 6 should fail to be ignited after the two ignition pulses thus far described, the first capacitor 10 is charged again and, in the next half cycle, the switching element 11 becomes conducting again at 500 V, so that an ignition pulse with a low peak value is generated, and so on.

If the lamp 6 has ignited, the voltage between the junction point 7 and the terminal 2 falls to practically the burning voltage of this lamp, so that the switching elements 11 and 15 remain non-conducting. The ignition device is thus blocked. The lamp current then flows in the circuit 1, 3, 4, 6, 2.

The capacitor 17 serves to short-circuit the high-frequency voltage peak from 4, so that this peak does reach the lamp (junction point 18) but not the ballast (junction point 7).

In a practical embodiment in which, as was stated, the breakdown voltage of the first switching element 11 was approximately 500 V and that of the second switching element 15 was approximately 750 V, the other components had approximately the following values:

capacitor 10: 0.2 μF
capacitor 14: 0.3 μF
capacitor 17: 10 nF
resistor 8: 15 kΩ
stabilizing ballast 3: 0.5 Henry:
transformation ratio of transformer 12/4: approximately 1/5.

Lamp 6 was a high-pressure sodium vapour discharge lamp of approximately 70 W with an operating voltage of approximately 90 V. In a modification, the switching element 15 may be connected to a primary winding of a second transformer (not shown) instead of to the junction point 16. An end of the latter primary winding may also be connected to junction point 7. It is conceivable for a secondary winding (not drawn) coupled to this primary winding to be situated, for example, in the branch between the lamp 6 and the junction point of the circuit of FIG. 1.

Figure 2:
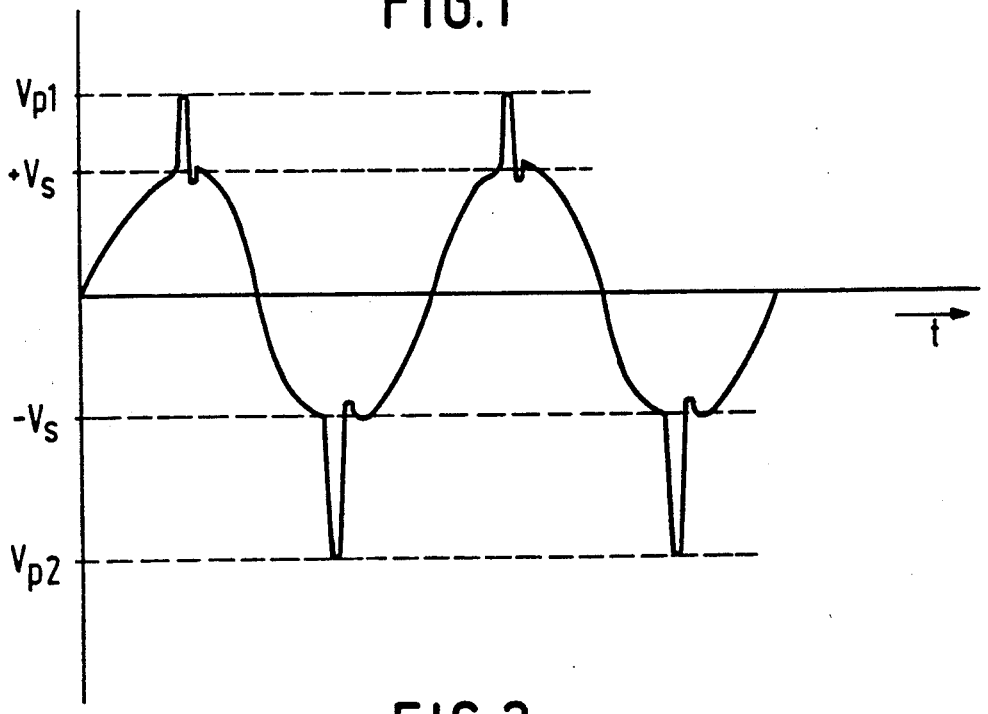
FIG. 2 shows the voltage generated by means of the circuit arrangement of FIG. 1 as a function of the time t during the ignition process.

In FIG. 2, $+V_s$ denotes the positive peak value of the mains voltage between the terminals 1 and 2 of the circuit of FIG. 1, and $-V_s$ denotes its negative peak value. $V_{p1}$ is a level of an ignition pulse occurring during a discharge of the first capacitor 10 and $V_{p2}$ is the level of an ignition pulse occurring during a discharge of the second capacitor 14. The absolute value of $V_{p2}$ is greater than that of $V_{p1}$.

The breakdown voltages of the switching elements 11 and 15 were so chosen, as is shown in FIG. 2, that an ignition pulse occurs near a moment at which the instantaneous mains voltage is at its maximum.

FIG. 2 further shows that $V_{p1}$ is generated during the positive half cycles, also called odd half cycles. This is a pulse which in the present case is exclusively suitable for igniting lamp 6 in the cold state. During the negative or even half cycles, a pulse $V_{p2}$ with a higher peak value is generated, which is suitable for igniting lamp 6 in the hot state.

$V_{p1}$ was approximately 6000 V and $V_{p2}$ approximately 8000 V in the embodiment described.

FIG. 2 shows, as will be clear, a situation in which lamp 6 is assumed to be absent.

A simple circuit arrangement according to the invention generates, as shown above, alternately an ignition pulse having a low peak value and one having a high peak value, starting with a low one. This spares the insulation material of the lamp while still meeting the requirements for both cold and hot ignition of the lamp.

I claim:

1. A circuit arrangement suitable for igniting a high pressure discharge lamp, which arrangement is to be fed from an AC voltage source and is provided with a first series circuit comprising a first rectifier and a first capacitor, and in which a second series circuit comprising at least a first switching element and a primary winding of a transformer is connected to a junction point between the first rectifier and the first capacitor, while an output terminal of the circuit arrangement is connected to a secondary winding of said transformer, the circuit arrangement further comprising a third series circuit comprising a second rectifier and a second capacitor, the forward directions of the rectifiers being of different orientation relative to the supply source, characterized in that a second switching element is present in a branch between on the one hand a junction point between the second rectifier and the second capacitor and on the other hand said primary winding, which primary winding is coupled to said secondary winding connected to said output terminal, and in that said switching elements are alternately conducting.

2. A switching device as claimed in claim 1, characterized in that the first capacitor together with the second series circuit forms part of an oscillation circuit across whose ends there is an AC voltage in the operational state while the first switching element is conducting, and the third series circuit bypasses a portion of said oscillation circuit comprising the first capacitor, the first switching element and the primary winding of the transformer.

3. A switching device as claimed in claim 1, or 2, characterized in that each of the two switching elements is constructed as a breakdown element.

4. A switching arrangement as claimed in claim 3, characterized in that the breakdown voltage of the second switching element is greater than that of the first switching element.

5. A circuit arrangement as claimed in claim 2, characterized in that an end of the primary winding of the transformer remote from the first switching element is connected to a junction point between the secondary winding of the transformer and a stabilizing ballast.

* * * * *